US011299382B2

(12) United States Patent
Duncan

(10) Patent No.: US 11,299,382 B2
(45) Date of Patent: Apr. 12, 2022

(54) SYSTEM AND METHOD FOR APPLYING TUBULAR TAMPER EVIDENT BANDS TO CONTAINERS

(71) Applicant: Axon LLC, Apex, NC (US)

(72) Inventor: Adam W. Duncan, Apex, NC (US)

(73) Assignee: AXON LLC, Raleigh, NC (US)

( * ) Notice: Subject to any disclaimer, the term of this patent is extended or adjusted under 35 U.S.C. 154(b) by 0 days.

(21) Appl. No.: 16/890,300

(22) Filed: Jun. 2, 2020

(65) Prior Publication Data

US 2021/0371264 A1 Dec. 2, 2021

(51) Int. Cl.
*B67B 5/00* (2006.01)
*B67B 5/03* (2006.01)

(52) U.S. Cl.
CPC ..... *B67B 5/036* (2013.01)

(58) Field of Classification Search
CPC .... B67B 5/034; B67B 5/036; B65C 3/065–20
USPC ..... 53/399
See application file for complete search history.

(56) References Cited

U.S. PATENT DOCUMENTS 4,562,688 A 1/1986 Mueller
4,914,893 A * 4/1990 Strub ..... B65C 3/065 53/292
5,711,135 A 1/1998 Menayan
6,684,599 B1 * 2/2004 Fresnel ..... B65B 9/14 53/585
7,398,811 B1 7/2008 Duncan

* cited by examiner

*Primary Examiner* — Chelsea E Stinson
(74) *Attorney, Agent, or Firm* — Thompson Hine LLP

(57) ABSTRACT

A method of applying a tamper evident band involves: moving a container in a feed direction below and past a mandrel assembly that includes a lower end with a band guide structure; utilizing the mandrel assembly to form a tamper evident band; ejecting the tamper evident band downward from the mandrel assembly toward the container before the container is completely under the mandrel assembly causing a leading side of the tamper evident band to move over a leading side of a cap and neck section of the container while a trailing side of the tamper evident band is above a trailing side of the cap and neck section of the container; and as the container continues to move past the mandrel assembly, the band guide structure pushes the trailing side of the tamper evident band over the trailing side of the cap and neck section of the container.

14 Claims, 10 Drawing Sheets

SYSTEM AND METHOD FOR APPLYING TUBULAR TAMPER EVIDENT BANDS TO CONTAINERS

TECHNICAL FIELD

The present application relates generally to machines that apply tubular shrink sleeve material to containers and, more particularly, to a system and method for applying tamper evident bands to the necks of containers.

BACKGROUND

Tubular shrink sleeve application devices commonly utilize a mandrel over which a tubular shrink film is moved for cutting, and then the cut sleeve-type label is ejected from the mandrel onto a container located below the mandrel. A downstream application of heat can then be used to shrink the film. These same sleeving machines are used to apply tamper evident bands (TE band) to the cap and neck section of containers. Generally, the TE band is simply a shorter sleeve that is sized so it will not fit around the main body of the container so that the band will engage with the cap and neck section of the container during the heat shrink. The TE band therefore provides an indication of whether the container has been opened. Because of the typical short of height of TE bands, they can be difficult to apply to contains at high speeds.

Therefore, it would be desirable and advantageous to provide a system and method that enhances the ability to effectively and expediently apply tamper evident bands.

SUMMARY

In one aspect, a machine for applying a tamper evident band to a container includes a mandrel assembly about which tubular film is passed, the mandrel assembly include a lower output end, a conveyor for moving a container in a feed direction below the output end of the mandrel assembly, a film cutter positioned for cutting the tubular film into a tamper evident band sized for application to a cap and neck section of the container and a band ejection arrangement for ejecting the tamper evident band from the mandrel assembly toward the conveyor. The output end of the mandrel assembly includes a band guide structure that includes an upstream side and a downstream side, relative to the feed direction, and a downwardly angled portion extending between the upstream side and the downstream side. The upstream side of the band guide structure is positioned at a first height and the downstream side of the band guide structure is positioned at a second height that is lower than the first height.

In another aspect, a machine for applying a tamper evident band to a container moving in a feed direction includes a mandrel assembly about which tubular film is passed, the mandrel assembly include a lower output end, a film cutter positioned for cutting the tubular film into a tamper evident band sized for application to a cap and neck section of the container and a band ejection arrangement for ejecting the tamper evident band from the mandrel assembly. The output end of the mandrel assembly includes a band guide structure that includes an upstream side and a downstream side, relative to the feed direction, and a downwardly angled portion extending between the upstream side and the downstream side. The upstream side of the band guide structure is positioned at a first height and the downstream side of the band guide structure is positioned at a second height that is lower than the first height.

In a further aspect, a method of applying a tamper evident band to a cap and neck section of a container involves the steps of: moving a container in a feed direction below and past a mandrel assembly that includes a lower end with a band guide structure, the band guide structure having an upstream side and a downstream side, relative to the feed direction, and a downwardly angled portion extending between the upstream side and the downstream side; utilizing the mandrel assembly to form a tamper evident band; ejecting the tamper evident band downward from the mandrel assembly toward the container before the container is completely under the mandrel assembly causing a leading side of the tamper evident band to move over a leading side of a cap and neck section of the container while a trailing side of the tamper evident band is above a trailing side of the cap and neck section of the container; and, as the container continues to move past the mandrel assembly, the band guide structure pushes the trailing side of the tamper evident band over the trailing side of the cap and neck section of the container.

In a further aspect, a method of applying a tamper evident band to a cap and neck section of a container involves the steps of: moving a container in a feed direction along a feed path below a mandrel assembly that includes a lower end with a band guide structure, the band guide structure having an upstream side and a downstream side, relative to the feed direction, and a downwardly angled portion extending between the upstream side and the downstream side; utilizing the mandrel assembly to form a tamper evident band; moving the tamper evident band downward from the mandrel assembly around the band guide structure and toward the feed path before the container is completely under the mandrel assembly causing a leading side of the tamper evident band to move down past a top of the container and alongside a leading side of a cap and neck section of the container while a trailing side of the tamper evident band contacts the top of the container to remain above a trailing side of the cap and neck section of the container; and, as the container continues to move past the mandrel assembly, the band guide structure pushes the trailing side of the tamper evident band over the trailing side of the cap and neck section of the container.

In a further aspect, a method of applying a tamper evident band to a cap and neck section of a container involves: moving a container in a feed direction along a feed path below a mandrel assembly; utilizing the mandrel assembly to form a tamper evident band; and moving the tamper evident band downward from the mandrel assembly and toward the feed path by ejecting a leading side of the tamper evident band from the mandrel assembly sooner than and/or faster than a trailing side of the tamper evident band is ejected from the mandrel assembly.

In another aspect, a machine for applying a tamper evident band to a container moving in a feed direction includes a mandrel assembly about which tubular film is passed, the mandrel assembly include a lower output end, a film cutter positioned for cutting the tubular film into a tamper evident band sized for application to a cap and neck section of the container and a band ejection arrangement for ejecting the tamper evident band from the mandrel assembly. The band ejection arrangement includes a first ejector wheel and a second ejector wheel, diametrically opposed to each other along the feed direction, wherein the first ejector wheel and the second ejector wheel are independently operable, wherein the first ejector wheel is a downstream ejector wheel and the second ejector wheel is an upstream ejector wheel.

The details of one or more embodiments are set forth in the accompanying drawing and the description below. Other features, objects, and advantages will be apparent from the description and drawing, and from the claims.

DETAILED DESCRIPTION

Figure 1:
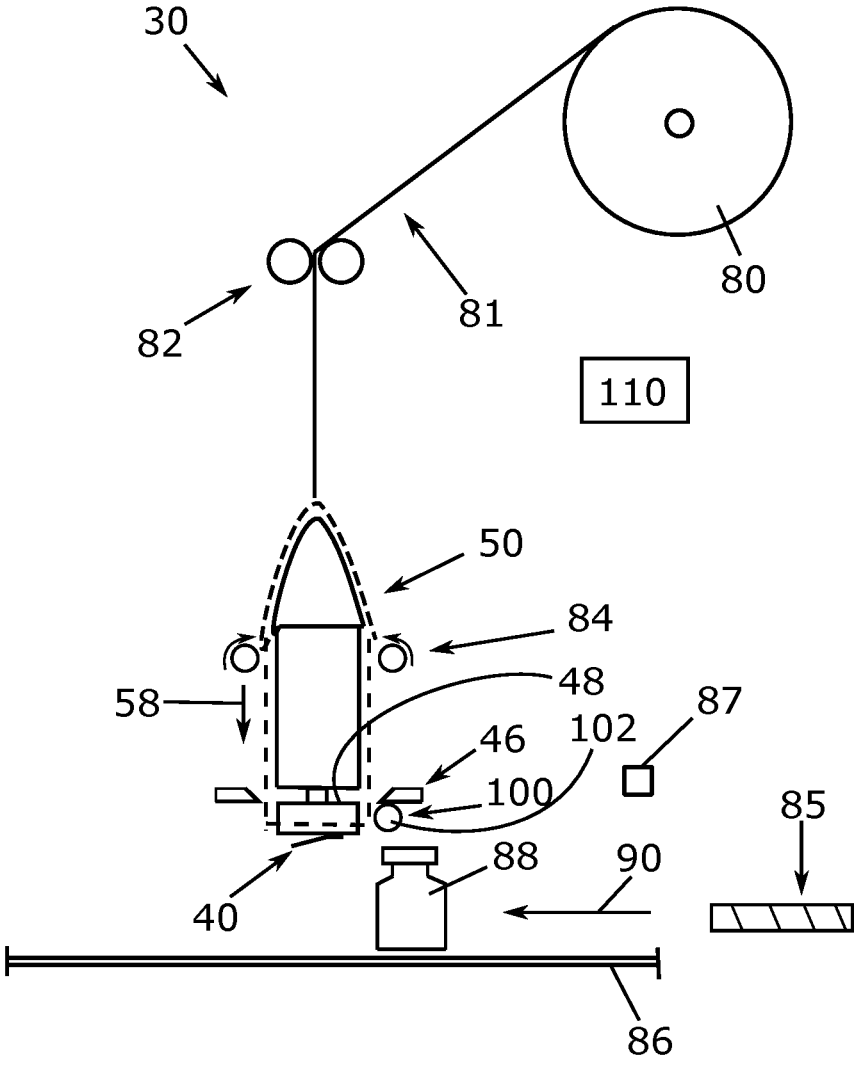
FIG. 1 is a schematic side elevation of one embodiment of a tubular shrink sleeve applying apparatus.

An exemplary tubular shrink sleeve applying apparatus 30 is shown in schematic form in FIG. 1 and includes a roll 80 or other supply of tubular film that delivers the film along a film feed path 81 to a pair of tubular film drivers 82 located above the tooling mandrel 50 for moving the film down toward the mandrel. The top of the tooling mandrel is shaped to cause the tubular film to spread from its flat orientation to an expanded orientation as it moves down around the mandrel 50. A set of film drive rollers 84 control feeding of the film downward along the mandrel (e.g., per arrow 58) toward a cutting mechanism 46 that is aligned with a cutting slot 48 in the external surface of the tooling mandrel. Film drivers 84 operate in coordination with drivers 82 and interact with rollers in the sleeve drive slots to move the tubular film downward along the mandrel assembly. A container conveyor 86 passes beneath the lower output end of the mandrel and carries containers 88 in a conveyance direction 90 such that cut bands that are moved off the mandrel move toward the conveyor and any passing container. The container conveyance system 83 may also include an upstream container spacing device 85, such as a rotating product feed screw, to provide a set distance between successive containers moving past the exit end of the mandrel during sleeve application. One or more sensors 87 may also be provided for detecting container position, with the controller configured to initiate band ejection based upon container detection. The cut band may, for example, be ejected off the mandrel with the assistance of a sleeve ejection arrangement 100 made up of one or more ejector wheels 102. A downstream application of heat can then be used to shrink the film. Other variations of the apparatus are possible, including embodiments that do not include the film drivers 82 and embodiments in which other mechanisms for sleeve ejection are provided. For instance, U.S. Pat. App. Pub. No. 2015/0096675, commonly assigned to assignee of the present application, and which is incorporated herein by reference, describes several eject arrangements. The various machine components, may, for example, be driven by respective servo-motors that enable precise control of speed and position, with a controller 110 provided for operating the motors etc.

Notably, the mandrel 50 includes a band guide structure 40 at the lower output end. As more clearly seen in FIGS. 2-5, the band guide structure 40 includes an upstream side 41 and a downstream side 42, relative to the feed direction 90, with a downwardly angled portion 43 extending between the upstream side 41 and the downstream side 42. Thus, the upstream side 41 of the band guide structure is positioned at a first height H1 above the conveyor 86 and the downstream side 42 of the band guide structure is positioned at a second height H2 above the conveyor 86, where the second height H2 is lower than the first height H1.

Here, the band guide structure 40 is formed as a separate piece that is connected to the bottom a main body 51 of the mandrel 50, such as by one or more fasteners 52 or by a screw in connection. Thus, the band guide structure 40 is removably connected to the main body of the mandrel. However, other variations are possible. The band guide structure 40 is sized to be within the external perimeter of the mandrel section that defines the tubular shape of the film so that a tamper evident band will move off the mandrel without interference from the band guide structure.

Figure 2:
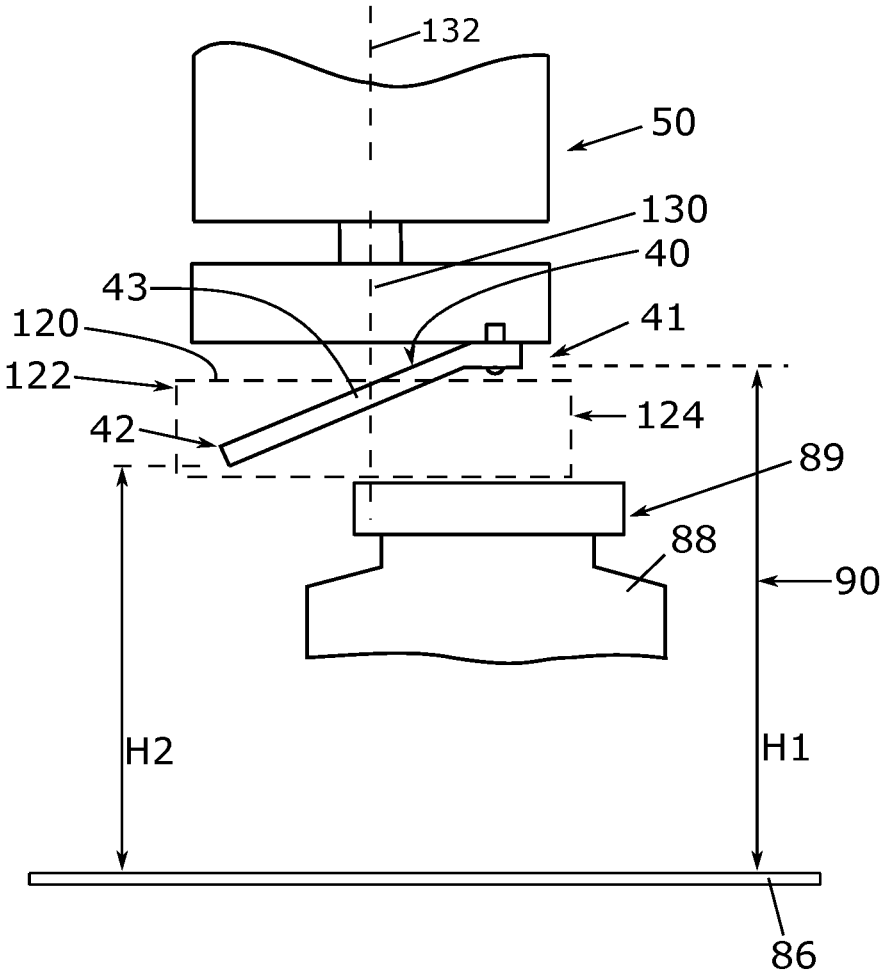
FIGS. 2-5 are schematic partial side elevations depicting progressive application of a tamper evident band to a container.
Figure 3:
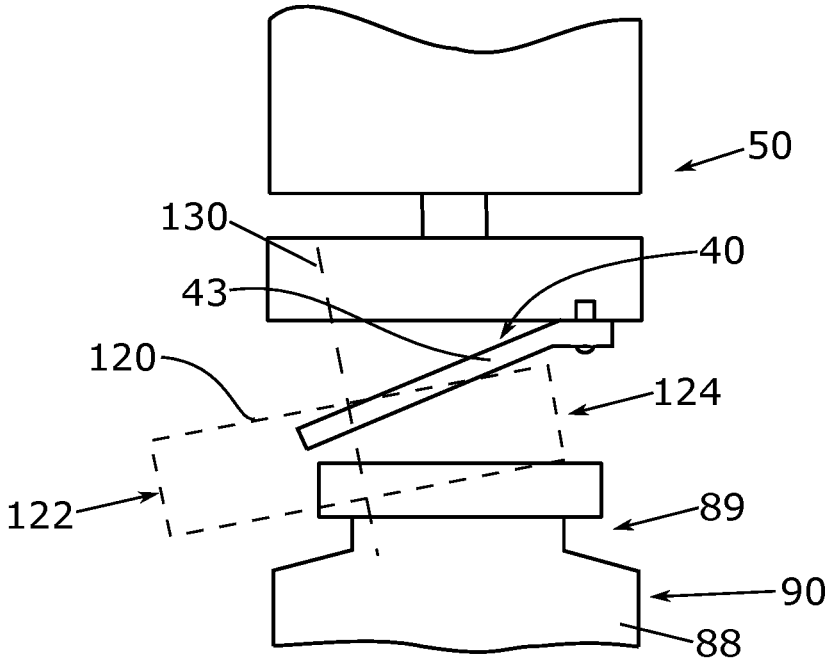
Figure 4:
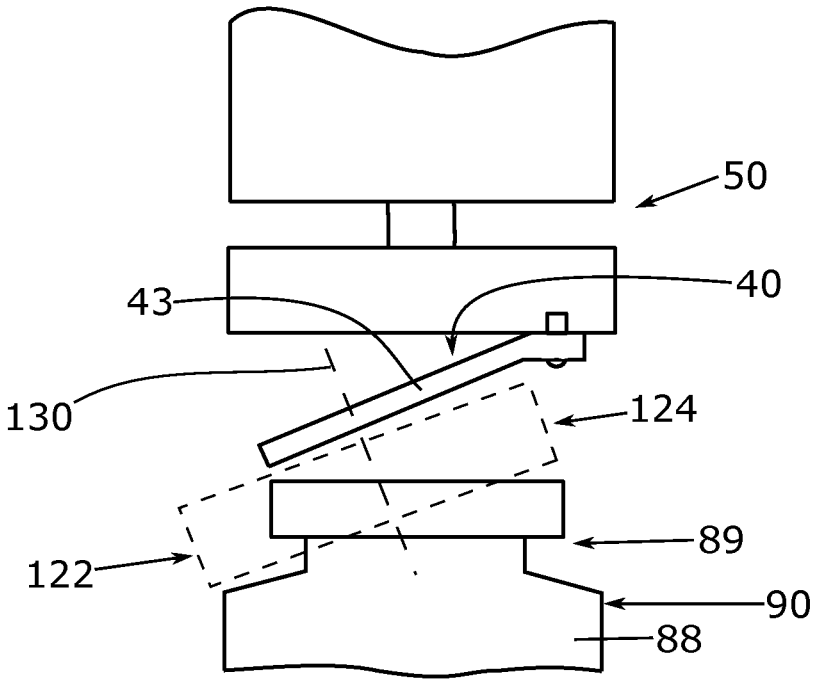
Figure 5:
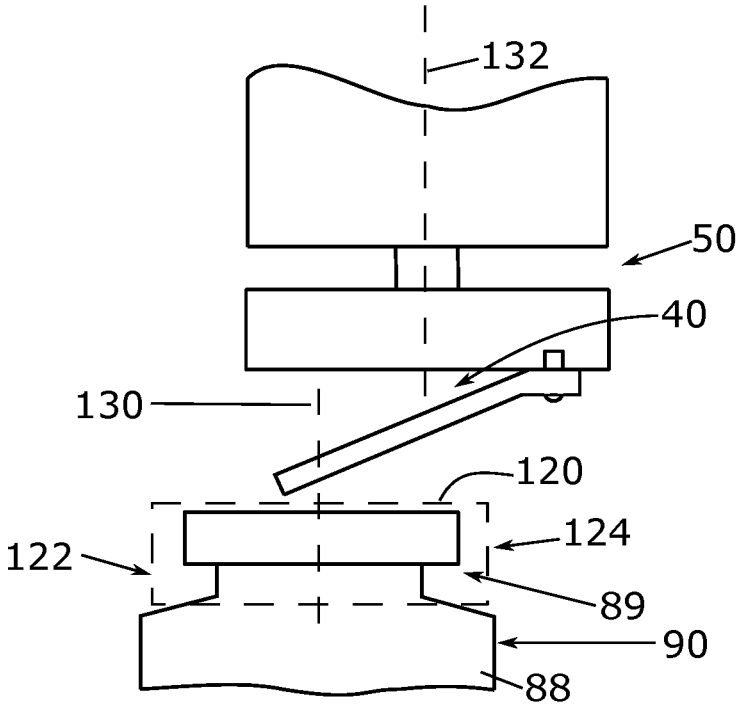

The controller 110 is configured to control the machine components (e.g., the conveyor and the band ejection arrangement) such that such that the tamper evident band 120 is ejected from the mandrel assembly before the container 88 is completely under the mandrel 50, per FIG. 2. This causes a leading (or downstream) side 122 of the tamper evident band, relative to a fed direction of the container, to move over a leading side of the cap and neck section 89 of the container while a trailing side 124 of the tamper evident band is above the cap and neck section of the container (as seen in FIGS. 3 and 4). As the container 88 continues to move past the mandrel 50, the band guide structure 40, particularly angled portion 43, pushes the trailing side 124 of the tamper evident band over the trailing side of the cap and neck section 89 of the container into the position shown in FIG. 5, where the band is supported on the neck section and extends above the top of the container cap. Notably, sufficient clearance is provided between the top of the container and the lowest part of the band guide structure 40 to permit the top edge of the band to pass below the band guide structure when in the position of FIG. 5. As used above, the terms leading side and trailing side, when referring to the tamper evident band and the neck and cap section of the container, are relative to the conveyance direction or feed direction 90 of the containers.

Thus, the machine provides for a method of applying a tamper evident band to a cap and neck section of a container. The method involves: moving a container in a feed direction below and past a mandrel assembly that includes a lower end with a band guide structure, the band guide structure having an upstream side and a downstream side, relative to the feed direction, and a downwardly angled portion extending between the upstream side and the downstream side; utilizing the mandrel assembly to form a tamper evident band (e.g. by cutting the film); ejecting the tamper evident band downward from the mandrel assembly toward the container before the container is completely under the mandrel assembly causing a leading side of the tamper evident band to move over a leading side of a cap and neck section of the container while a trailing side of the tamper evident band is above a trailing side of the cap and neck section of the container; and, as the container continues to move past the mandrel assembly, the band guide structure pushes the trailing side of the tamper evident band over the trailing side of the cap and neck section of the container.

The machine also provides for a method of applying a tamper evident band to a cap and neck section of a container, where the method involves: moving a container in a feed direction along a feed path below a mandrel assembly that includes a lower end with a band guide structure, the band guide structure having an upstream side and a downstream side, relative to the feed direction, and a downwardly angled portion extending between the upstream side and the downstream side; utilizing the mandrel assembly to form a tamper evident band; moving the tamper evident band downward from the mandrel assembly around the band guide structure and toward the feed path before the container is completely under the mandrel assembly causing a leading side of the tamper evident band to move down past a top of the container and alongside a leading side of a cap and neck section of the container while a trailing side of the tamper evident band contacts the top of the container to remain above a trailing side of the cap and neck section of the container; and, as the container continues to move past the mandrel assembly, the band guide structure pushes the trailing side of the tamper evident band over the trailing side of the cap and neck section of the container.

Notably, the tamper evident band 120 includes a central longitudinal axis 130. The tamper evident band is initially moved downward toward the feed path while the central longitudinal axis 130 is in a first orientation that runs substantially perpendicular to the feed direction 90 (per FIG. 2). As the leading side 122 of the tamper evident band 120 moves alongside the leading side of the cap and neck section of the container, the central longitudinal axis 130 moves into a second orientation in which the central longitudinal axis 143 runs partly downward and partly against the feed direction (per FIGS. 3 and 4). As the trailing side 124 of the tamper evident band 120 is moved over the trailing side of the cap and neck section of the container, the central longitudinal axis 130 moves back toward the first orientation (per FIG. 5). In the first orientation, the central longitudinal axis 130 of the tamper evident band 120 is substantially parallel to a central longitudinal axis 132 of the mandrel assembly 50.

Figure 6:
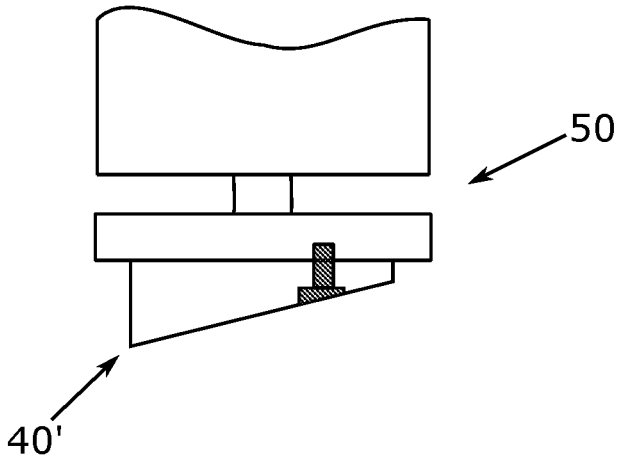
FIG. 6 shows a schematic partial side elevation of another embodiment of a mandrel band guide structure.
Figure 7:
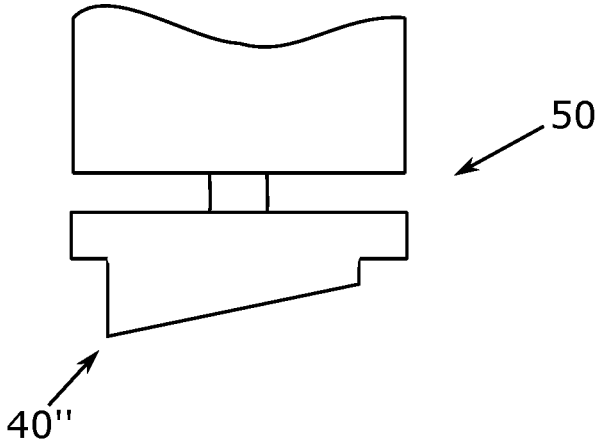
FIG. 7 shows a schematic partial side elevation of another embodiment of a mandrel band guide structure.

It is to be clearly understood that the above description is intended by way of illustration and example only, is not intended to be taken by way of limitation, and that other changes and modifications are possible. In particular, while FIGS. 2-5 show a band guide structure that is generally of bent plate configuration, other configurations are possible. For example, FIG. 6 shows an embodiment with a band guide structure 40' that is a tapered block body attached to the mandrel 50, while FIG. 7 shows an embodiment with a band guide structure 40" that is integral with the bottom section of the mandrel 50 (e.g., molded or machined as one piece). Still other variations and modifications are possible.

For example, referring to FIGS. 8A-8F, a system 200 with a mandrel assembly 202, diametrically opposed film feed wheels 204 and diametrically opposed ejector wheels 206A and 206B is shown, with an exemplary tubular band 208 shown in cross-hatch. The driving direction of each of the wheels 204 is shown by arrows 210. These wheels 204 pull the film web onto and over the mandrel assembly body. The driving direction of each of the ejector wheels 206A, 206B is shown by arrows 212. These wheels 206A, 206B are controlled to eject the band structure in a controller manner, with each wheel controlled by its own servo-motor to permit independent control of the two wheels (i.e., the two wheels do not have to move synchronously at all times). Notably, the wheels 206A and 206B are diametrically opposed along the travel direction 216 of containers 218 to be banded (i.e., parallel to the product travel direction) so that wheel 206B is an upstream ejector wheel and wheel 206A is a downstream ejector wheel. As shown, the lower output end of the mandrel assembly includes an angled band guide structure 214.

Figure 8A:
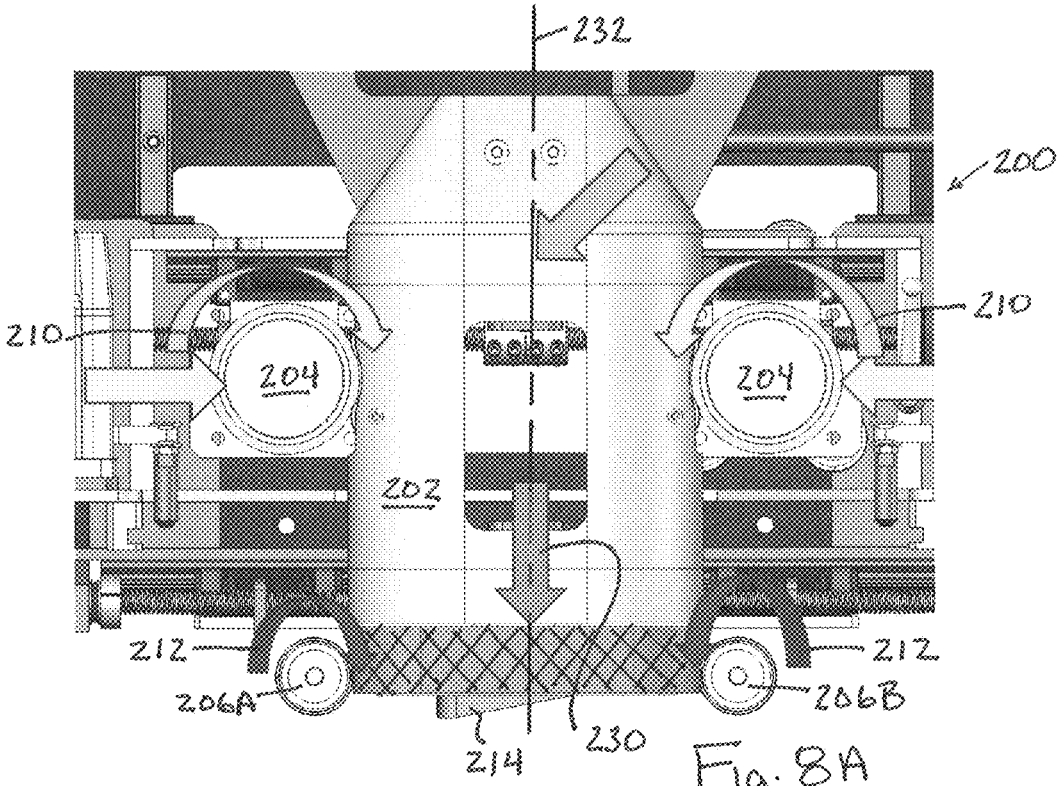
FIGS. 8A-8F show another embodiment in which the mandrel assembly includes diametrically opposed upstream and downstream ejector wheels.
Figure 8B:
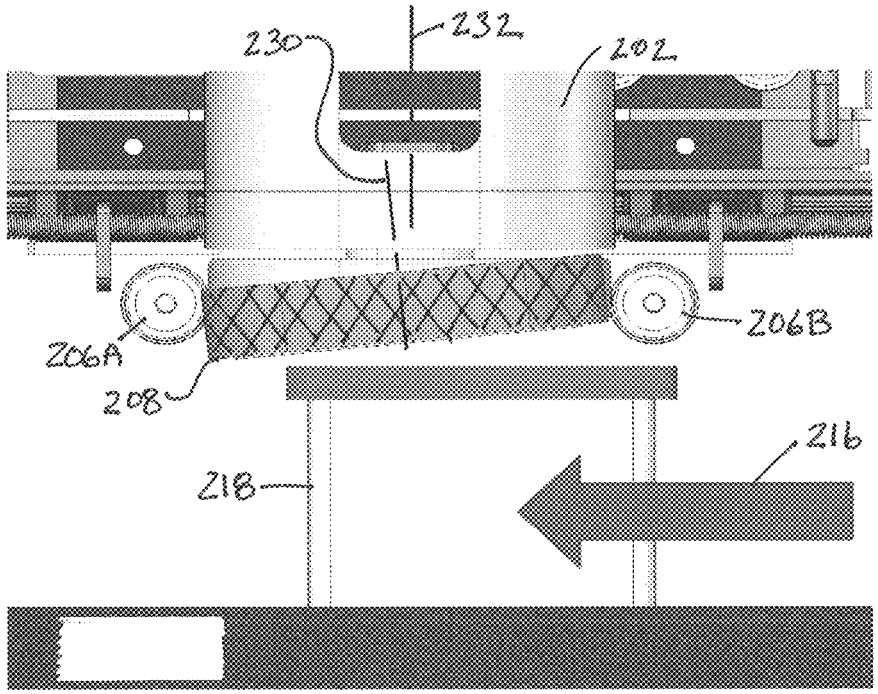
Figure 8C:
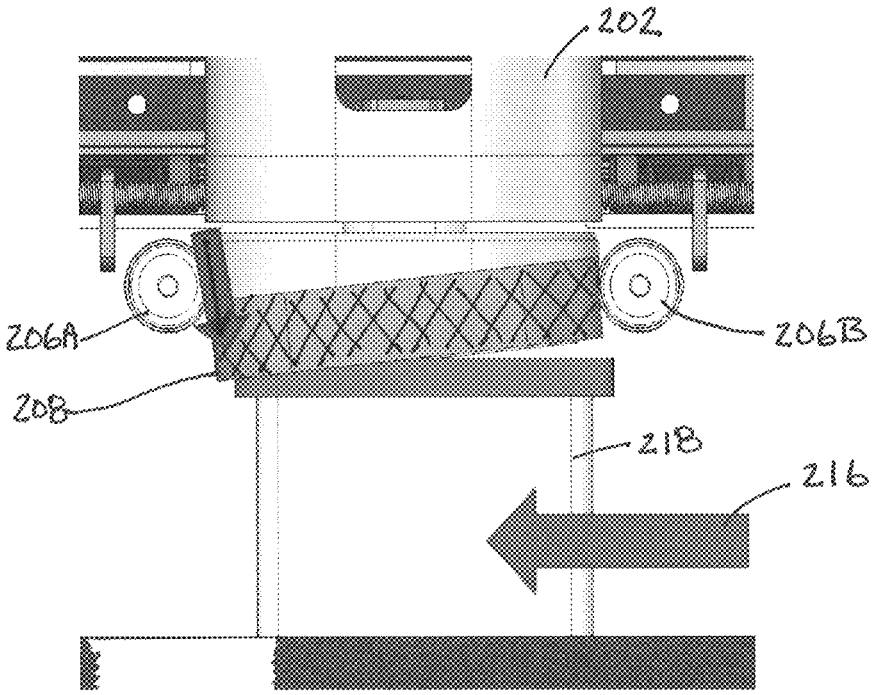
Figure 8D:
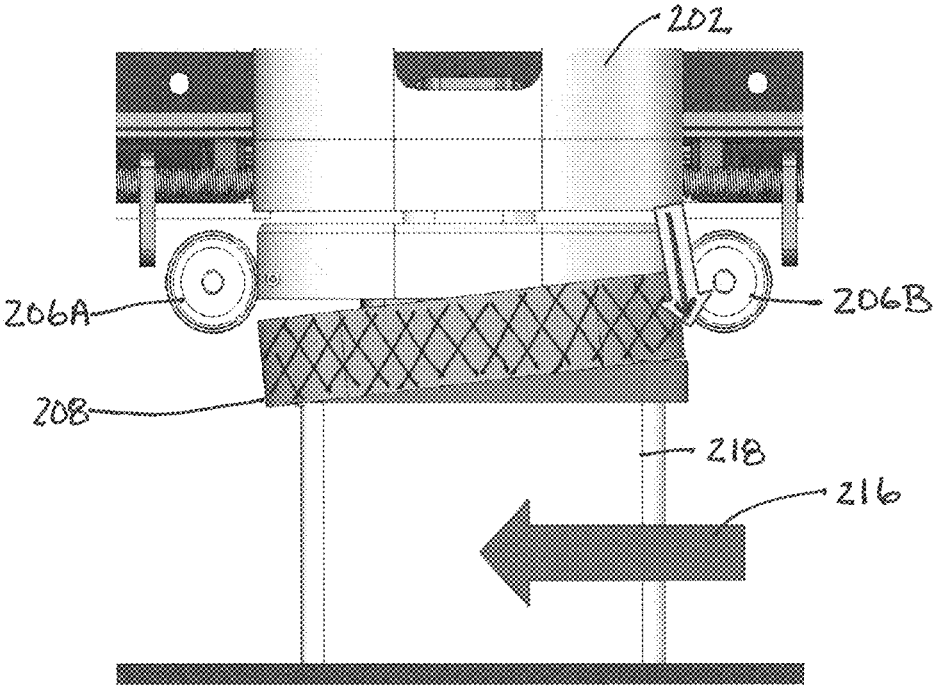
Figure 8E:
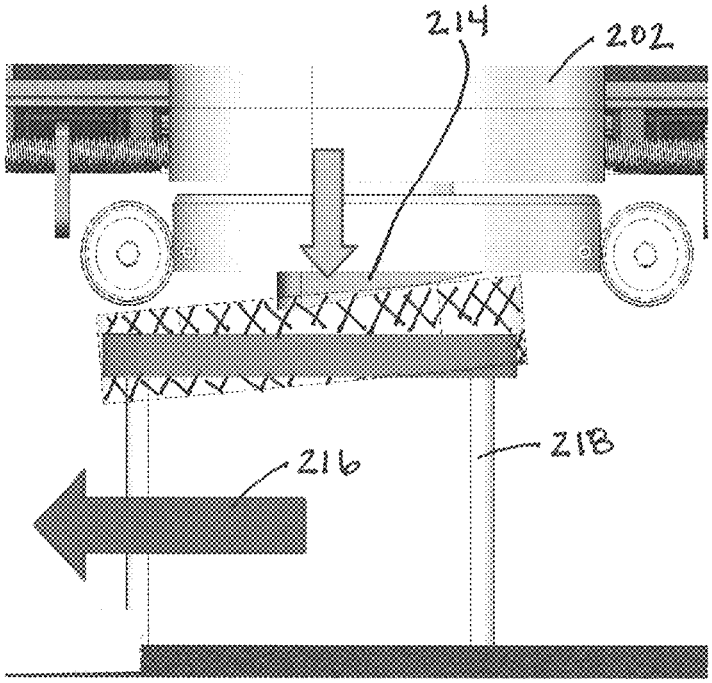
Figure 8F:
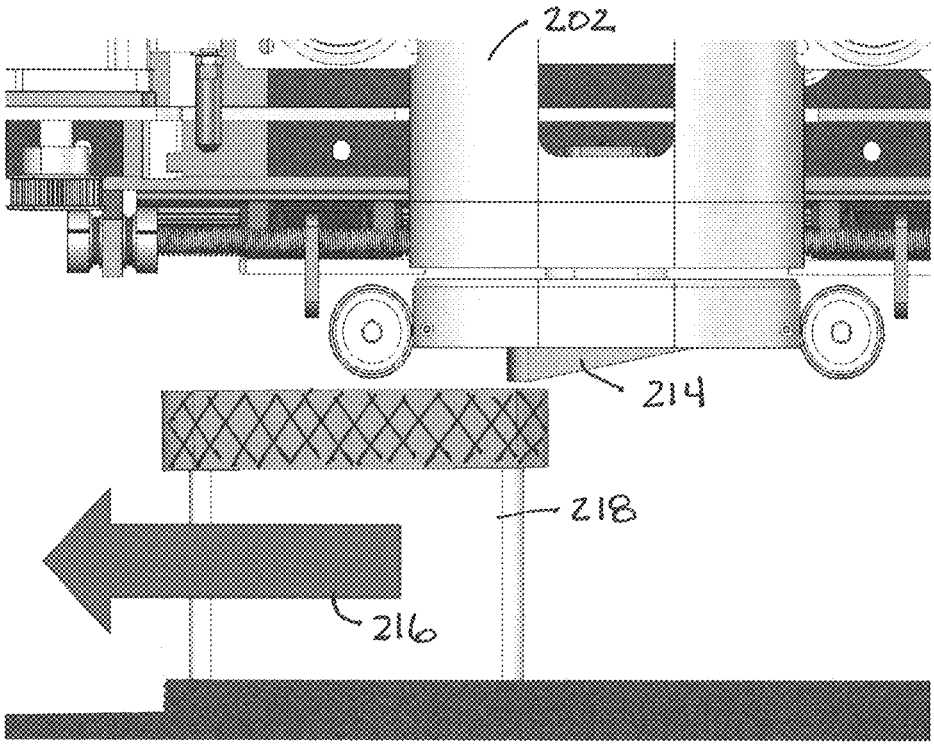

In FIG. 8A, the band 208 is in position at the bottom of the mandrel assembly, waiting to be ejected (e.g., both wheels 206 are stopped). In order to achieve this band position, the film is fed down over the mandrel, past the cutter and engages into the ejector wheels 206A and 206B evenly. The ejector wheels 206A, 206B are synced with the film feed's linear displacement to allow the film to be driven by both the film feed rollers 204 and the ejectors 206A, 206B at the same time and at the same rate. If not synced correctly, the ejector wheels 206A, 206B could cause the film to bunch or could burn a hole in the film. Once the film feed is complete, the ejector wheels are stopped, the knife cuts the band, and the system awaits a container to be banded.

As the container 218 moves beneath the mandrel, the downstream ejector wheel 206A is operated first, or at least faster than wheel 206B, causing the band 208 to tilt so that its axis 230 becomes offset from the mandrel axis 232, creating a lead-in angle for the leading side of the container 218 to run into. The upstream ejector wheel 206B operates at a later time, per FIGS. 8C and 8D, and/or advances the band 208 at a slower rate, to move the trailing side of the band down. This results in the leading side of the band being applied to the leading side of the container first, with the band guide structure 214 urging the trailing side of the band down onto the trailing side of the container as the container continues to move past the mandrel, per FIGS. 8E and 8F. However, the independent control of the upstream and downstream ejector wheels could also be implemented in connection with mandrel assemblies that do not include an angled band guide structure.

All applicable timers and motion profiles may be controllable/adjustable from the HMI of the system controller. For example, the HMI can be used to designate which ejector wheel is the upstream ejector wheel and which is the downstream ejector wheel, based upon the travel direction of containers to be banded. The band guide structure (or the entire mandrel assembly) can be connectable in two different orientations (e.g., the two positions rotationally offset by one-hundred eighty degrees) for this purpose, also depending upon the direction of container travel.

In one implementation of the system, the controller is configured such that the band 208 is cut and then the downstream ejector wheel is operated immediately (e.g., for a short cycle) to drop the leading side of the band down to wait for a container. In another implementation, the controller is configured to wait for a container to trigger the cycle (e.g., based upon container detection by a sensor) before operating the downstream ejector wheel to drop the leading side of the band down.

What is claimed is:

1. A machine for applying a tamper evident band to a container moving in a feed direction, the machine including:

a mandrel assembly about which tubular film is passed, the mandrel assembly include a lower output end;

a film cutter positioned for cutting the tubular film into a tamper evident band sized for application to a cap and neck section of the container;

a band ejection arrangement for ejecting the tamper evident band from the mandrel assembly, wherein the band ejection arrangement includes a first ejector wheel and a second ejector wheel, diametrically opposed to each other along the feed direction, wherein the first ejector wheel and the second ejector wheel are independently operable, wherein the first ejector wheel is a downstream ejector wheel and the second ejector wheel is an upstream ejector wheel; and a controller operatively connected to drive the first ejector wheel and the second ejector wheel, wherein the controller is configured to control the first ejector wheel and the second ejector wheel such that a leading side of the tamper evident band, relative to the feed direction, is ejected from the mandrel sooner than and/or faster than a trailing side of the tamper evident band.

2. The machine of claim 1, wherein the output end of the mandrel assembly includes a band guide structure that includes an upstream side and a downstream side, relative to the feed direction, and a downwardly angled portion extending between the upstream side and the downstream side;

wherein the upstream side of the band guide structure is positioned at a first height and the downstream side of the band guide structure is positioned at a second height that is lower than the first height.

3. The machine of claim 2, wherein the band guide structure is formed as a separate piece that is connected to a main body of the mandrel assembly.

4. The machine of claim 3, wherein the band guide structure is removably connected to the main body of the mandrel assembly.

5. The machine of claim 2, wherein the band guide structure is formed integral with a main body of the mandrel assembly.

6. The machine of claim 1, wherein the controller is configured for controlling the band ejection arrangement such that the tamper evident band is ejected from the mandrel assembly before the container is completely under the mandrel assembly causing the leading side of the tamper evident band to move over a leading side of the cap and neck section of the container while the trailing side of the tamper evident band is above the cap and neck section of the container.

7. The machine of claim 6, further comprising:

a sensor for detecting moving containers, wherein the controller is configured to cause the band ejection arrangement to eject the band based upon a trigger signal from the sensor.

8. The machine of claim 6, wherein, as the container continues to move past the mandrel assembly, the band guide structure pushes the trailing side of the tamper evident band over the trailing side of the cap and neck section of the container.

9. The machine of claim 1, further comprising:

a sensor for detecting moving containers, wherein the controller is configured to initiate a band ejection sequence based upon a trigger signal from the sensor.

10. A machine for applying a tamper evident band to a container moving in a feed direction, the machine including:

a mandrel assembly about which tubular film is passed, the mandrel assembly include a lower output end;

a film cutter positioned for cutting the tubular film into a tamper evident band sized for application to a cap and neck section of the container;

a band ejection arrangement for ejecting the tamper evident band from the mandrel assembly, wherein the band ejection arrangement includes a first ejector wheel and a second ejector wheel, diametrically opposed to each other along the feed direction, wherein the first ejector wheel and the second ejector wheel are independently operable, wherein the first ejector wheel is a downstream ejector wheel and the second ejector wheel is an upstream ejector wheel;

wherein the first ejector wheel is operated by a first servo motor and the second ejector wheel is operated by a second servo motor;

wherein a controller is configured to control the first servo motor and the second servo motor such that a leading side of the tamper evident band, relative to the feed direction, is ejected from the mandrel sooner than and/or faster than a trailing side of the tamper evident band.

11. A machine for applying a tamper evident band to a container moving in a feed direction, the machine including:

a mandrel assembly about which tubular film is passed, the mandrel assembly include a lower output end;

a film cutter positioned for cutting the tubular film into a tamper evident band sized for application to a cap and neck section of the container; and a band ejection arrangement for ejecting the tamper evident band from the mandrel assembly, wherein the band ejection arrangement includes a controller configured to eject the tamper evident band downward from the mandrel assembly by moving a leading side of the tamper evident band downward off of the lower end of the mandrel assembly sooner than and/or faster than a trailing side of the tamper evident band is moved downward off of the lower end of the mandrel assembly.

12. The machine of claim 11, wherein the mandrel assembly is located above a container feed path along which a container moves in the feed direction, wherein the leading side of the tamper evident band is downstream of the trailing side of the tamper evident band, relative to the feed direction.

13. The machine of claim 12, wherein the band ejection arrangement includes a downstream ejector wheel that is controlled by the controller to move the leading side of the tamper evident band for ejection, and an upstream ejector wheel that is controlled by the controller to move the trailing side of the tamper evident band for ejection, wherein the downstream ejector wheel is rotated by a first motor and the upstream ejector wheel is rotated by a second motor.

14. The machine of claim 12, wherein the band ejection arrangement includes a downstream band ejector that is controlled by the controller to move the leading side of the tamper evident band for ejection, and an upstream band ejector that is controlled by the controller to move the trailing side of the tamper evident band for ejection.

* * * * *